US009398781B1

(12) United States Patent
McCorkle et al.

(10) Patent No.: US 9,398,781 B1
(45) Date of Patent: Jul. 26, 2016

(54) HEADGEAR APPLIANCE MOUNTING AND RETENTION SYSTEM

(71) Applicant: Christopher McCorkle, Scottsdale, AZ (US)

(72) Inventors: Christopher McCorkle, Scottsdale, AZ (US); Chris Stalzer, Scottsdale, AZ (US); Josh Wedge, Phoenix, AZ (US)

( * ) Notice: Subject to any disclaimer, the term of this patent is extended or adjusted under 35 U.S.C. 154(b) by 468 days.

(21) Appl. No.: 13/678,366

(22) Filed: Nov. 15, 2012

Related U.S. Application Data

(60) Provisional application No. 61/560,009, filed on Nov. 15, 2011.

(51) Int. Cl.
*A45B 11/04* (2006.01)
*A42B 1/24* (2006.01)

(52) U.S. Cl.
CPC ..... *A42B 1/244* (2013.01)

(58) Field of Classification Search
CPC ..... A42B 3/185; A42B 3/04; A42B 3/0433; A42B 3/0426; A42B 3/042; A42B 3/0406; A42B 1/245; A42B 1/247; A42B 1/244; A42B 1/242; A42B 1/24; A61F 9/027
USPC ..... 224/181, 269, 666, 667, 668, 671, 672, 224/673; 2/3.12, 422, 209.13, 6.2–6.5, 452, 2/10; 351/155
See application file for complete search history.

(56) References Cited

U.S. PATENT DOCUMENTS

| | | | | |
|---|---|---|---|---|
| D33,452 | S * | 10/1900 | Pax | D19/65 |
| 3,100,324 | A * | 8/1963 | Tutino et al. | 24/346 |
| 6,694,530 | B2 * | 2/2004 | Maloney | 2/421 |
| 2003/0126722 | A1 * | 7/2003 | Thompson | 24/3.12 |

* cited by examiner

*Primary Examiner* — Adam Waggenspack
*Assistant Examiner* — Matthew Theis
(74) *Attorney, Agent, or Firm* — Schmeiser, Olsen & Watts LLP

(57) ABSTRACT

A headgear appliance mounting and retention system is provided. The system utilizing specially designed clips that include at least two small clips and at least one large clip. The clips are attachable to headgear, particularly protective headgear, headwear or helmets such as, but not limited to, helmets worn by firefighters, utility workers, industrial/construction workers, or the like. The small clips are configured to receive and retain a strap of an accessory and the large clip is configured to simultaneously receive and retain straps of multiple accessories.

11 Claims, 5 Drawing Sheets

HEADGEAR APPLIANCE MOUNTING AND RETENTION SYSTEM

CROSS REFERENCE TO RELATED APPLICATION[S]

This application claims priority to U.S. Provisional Patent Application entitled "HEADGEAR APPLIANCE MOUNTING AND RETENTION SYSTEM," Ser. No. 61/560,009, filed Nov. 15, 2011, the disclosure of which is hereby incorporated entirely herein by reference.

BACKGROUND OF THE INVENTION

1. Technical Field

This invention relates generally to a headlamp, and eye protection (goggles), or other headgear appliance mounting system (including the headgear) and more particularly to a versatile headlamp/goggle retention system utilizing specially designed clips attachable to headgear, particularly protective headgear, headwear or helmets such as those, but not limited to, worn by firefighters, utility workers, industrial/construction workers, or the like.

2. State of the Art

Firefighters, utility workers, construction/industrial workers, recreation users such as campers, spelunkers, bicycle and motorcycle users or equivalent users, and others commonly use headlamps, in areas where hands free illumination is required. These situations often require that eye protection, such as goggles, be used as well. If it becomes necessary for these individuals to hold a flashlight in one hand for illumination, the individual's ability to effectively and safely operate equipment, and perform duties in these conditions may be seriously impaired. Headlamps and goggles utilize straps that wrap around a helmet, or hardhat. These headgears of various shapes all share a commonality in that they are conical in shape. Invariably the straps from these items will move, slip, and eventually fall off the headgear.

Various headlamps often have incorporated silicone, or rubberized straps in a passive attempt keep the straps in the optimal position on the headgear (this position will vary dependent upon the specific headgear in use). Those skilled in the use of headlamps will immediately recognize the need to use headlamps away from the headgear, or helmet, such as in camp after a work cycle, or anytime hands free lighting is needed without the need for head protection. At such times, the rubberized, or silicone infused, or similarly treated strap becomes very cumbersome to use and adjust.

Some helmets come from the factory with small preinstalled clips that are not designed to withstand the forces, or conditions (example: heat that firefighters regularly encounter) that today's headlamps singularly, and headlamp/goggle routinely encounter, and these combinations will often fall off once the preinstalled clips invariably fail.

While these helmet manufacturer devices have had some very limited success, accordingly, there is a need for an improved system that provides a number of significant improvements, benefits, and efficiencies.

SUMMARY OF THE INVENTION

The present invention relates to a headgear appliance mounting and retention system utilizing specially designed clips attachable to headgear, particularly protective headgear, headwear or helmets such as, but not limited to, helmets worn by firefighters, utility workers, industrial/construction workers, or the like.

Particular embodiments of the present invention include a headgear appliance mounting and retention system, the system comprising a set of clips, the set of clips comprising at least two small clips and at least one large clip. Further, other embodiments may include system comprising at least one small clip, and further still other embodiments may include a system comprising at least one large clip.

In some embodiments, each small clip comprises a top portion having relief channels, a bottom portion having a concave bottom surface, a gap between the top and bottom portions, the gap having a width, and an adhesive layer coupled to the bottom surface of the bottom portion, wherein the adhesive layer couples the small clip to a user defined location on a headgear.

In some embodiments, the large clip comprises a top portion having relief channels, a bottom portion having a concave bottom surface, a gap between the top and bottom portions, the gap having a width that is greater than the width of the gap of the small clip, and an adhesive layer coupled to the bottom surface of the bottom portion, wherein the adhesive layer couples the small clip to a user defined location on a headgear. The gap of the small clip is sized to receive and retain a strap of an accessory and the gap of the large clip is sized to simultaneously receive and retain straps of multiple accessories.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to a headgear appliance mounting and retention system utilizing specially designed clips attachable to headgear, particularly protective headgear, headwear or helmets.

Figure 1:
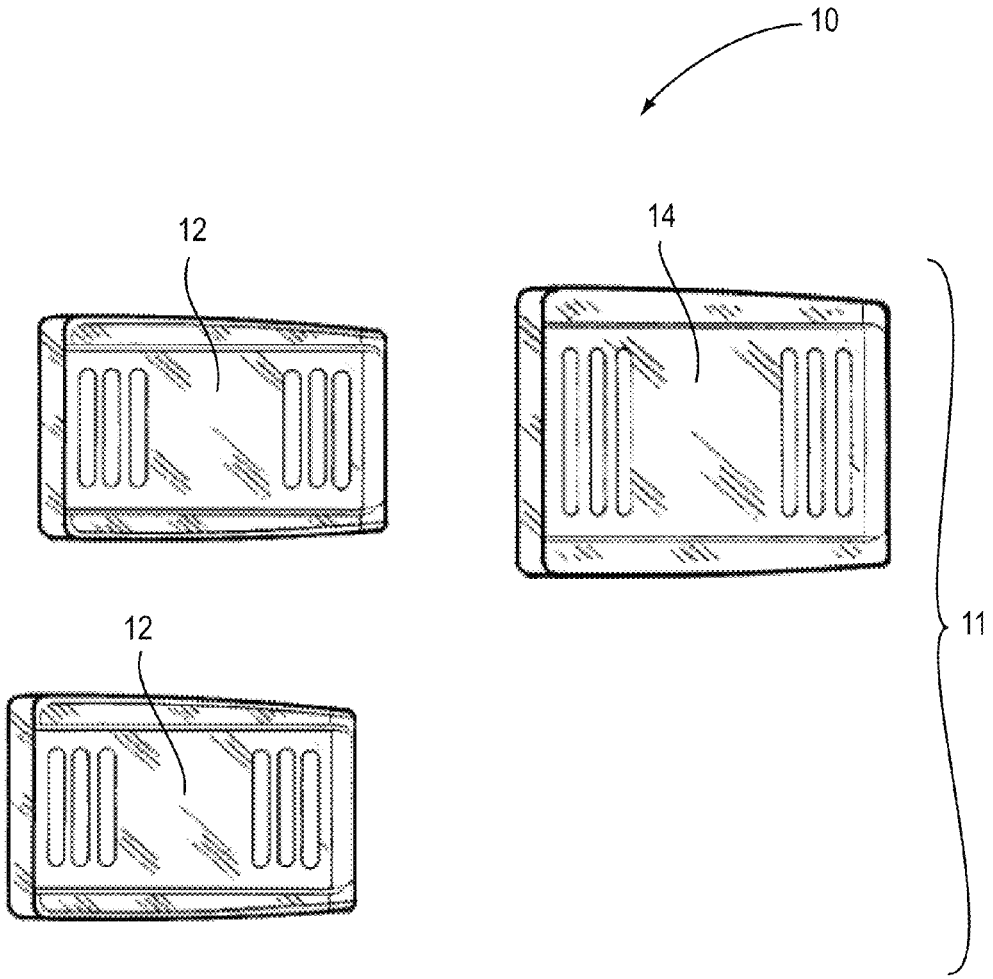
FIG. 1 is a view of a headgear appliance mounting and retention system.
Figure 2D:
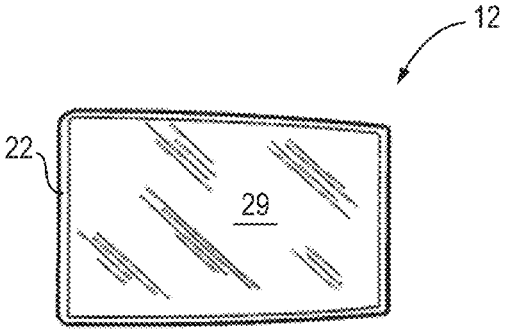
FIG. 2D is a bottom view of a small clip of a headgear appliance mounting and retention system.
Figure 2C:
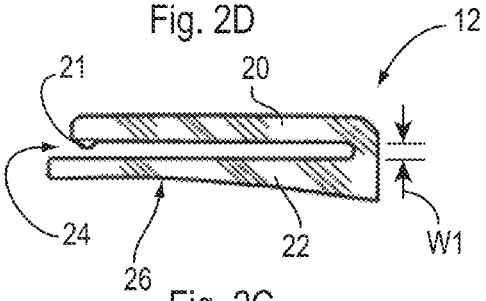
FIG. 2C is a side view of a small clip of a headgear appliance mounting and retention system.
Figure 2B:
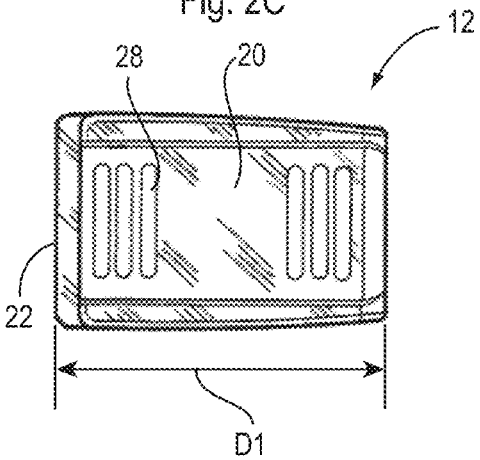
FIG. 2B is a top view of a small clip of a headgear appliance mounting and retention system.
Figure 2E:
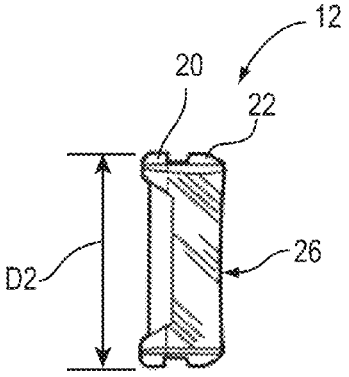
FIG. 2E is an end view of a small clip of a headgear appliance mounting and retention system.
Figure 2A:
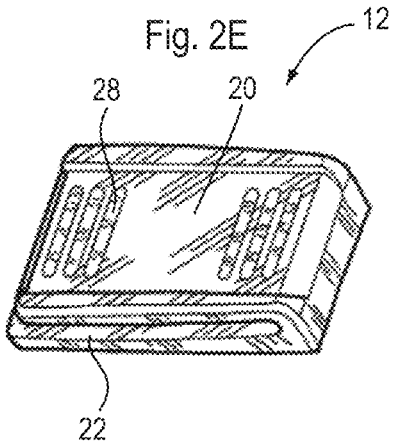
FIG. 2A is a perspective view of a small clip of a headgear appliance mounting and retention system.
Figure 3D:
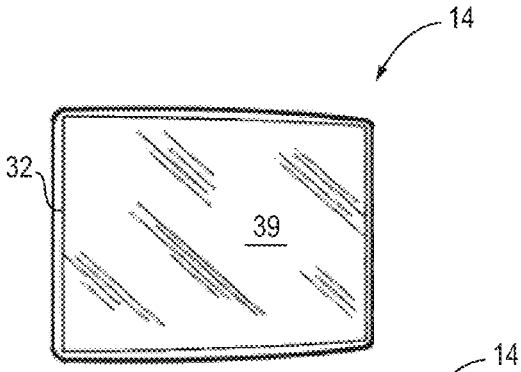
FIG. 3D is a bottom view of a large clip of a headgear appliance mounting and retention system.
Figure 3C:
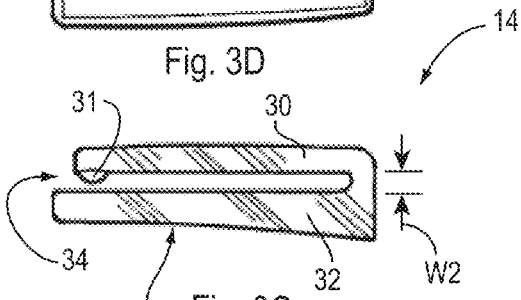
FIG. 3C is a side view of a large clip of a headgear appliance mounting and retention system.
Figure 3B:
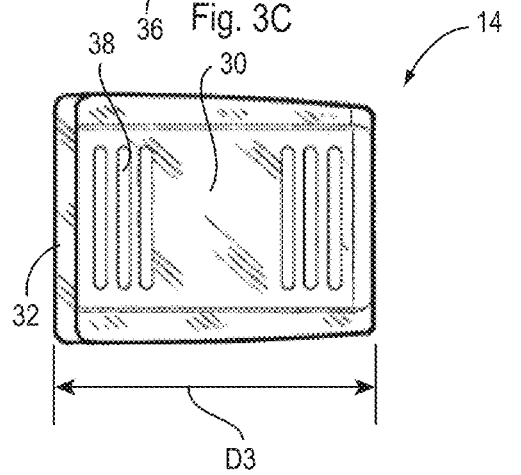
FIG. 3B is a top view of a large clip of a headgear appliance mounting and retention system.
Figure 3E:
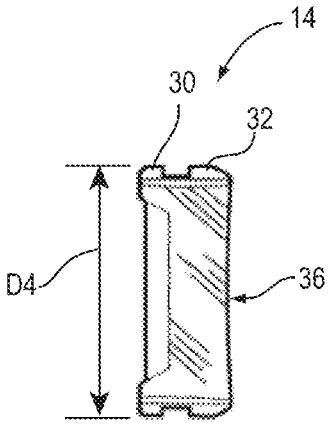
FIG. 3E is an end view of a large clip of a headgear appliance mounting and retention system.
Figure 3A:
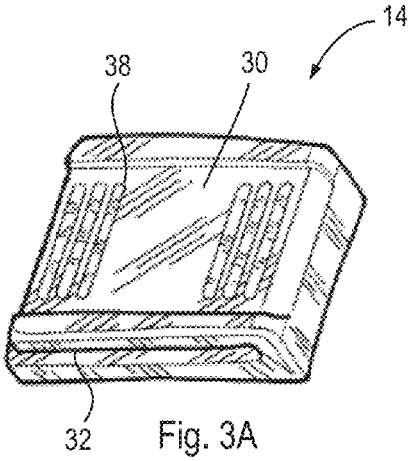
FIG. 3A is a perspective view of a large clip of a headgear appliance mounting and retention system.

As shown in FIG. 1, embodiments of the present invention provides for retaining of straps commonly found in headlamps, and goggles, by utilizing a headgear appliance mounting and retention system 10 comprising a set of at least three clips that can be placed at the discretion of the user to best suit the specific need to retain or position the straps. FIG. 1 depicts, for example and without limitation, the system 10 comprising a set 11 of clips comprising at least two small clips 12 and at least one large clip 14. The system 10 provides for a plurality of possible configurations depending upon, but not limited to, the headlamp, goggle, helmet, or user specific need. The specially designed clips 12 and 14 have a concave back to accommodate the conical shape found in common headgear. The system 10, in one particular embodiment, is specifically designed to fit a wide range headgear by utilizing a set of approximately 1 inch square clips 12 and 14 of unique design, but could be of varying size depending upon the need of the strap, or straps, or helmet.

Further, other embodiments may include a system 10 that comprises at least one small clip 12. Other embodiments may include a system 10 that comprises at least one large clip 14.

Referring further to the drawings, FIGS. 2A-2E depict a small clip 12 according to particular embodiments of the present invention. The small clip 12 comprises a first top portion 20, a first bottom portion 22 and a first gap 24 between the first top portion 20 and the first bottom portion 22. The first gap 24 is formed by the coupling of the first top portion 20 to the first bottom portion 22 on one end, wherein the first gap 24 may resemble a channel when viewed from a side of the small clip 12. The first gap 24 has a first width W1. On an interior side of the first top portion 20, wherein the interior side comprises the side facing the first bottom portion 22, a first protrusion 21 is coupled to an end adjacent an opening of the first gap 24. The first protrusion 21 may function to engage a strap by friction or by extending on one side of a strap inserted within the first gap 24. The small clip may comprise a first length D1 taken in a direction from the open end to the closed end of the first gap 24 and a second length D2 taken in a direction extending from one side to the other side of the first gap 24.

The first bottom portion 22 may include a concave surface 26. The concave surface 26 operates to accommodate the round and/or conical shape found in common headgear and helmets. Coupled to the concave surface 26 is an first adhesive layer 29. The adhesive layer may further include a paper backing (not shown) wherein a user may remove the paper backing and apply the first adhesive layer 29 to protective headgear at a user determined location. The first adhesive layer 29 retains the small clip 12 in that location and further secures the first bottom portion 22 in a fixed relationship with respect to the headgear. Once the first bottom portion 22 is secured in this fixed relationship with respect to the headgear, the top portion may flex in order to widen the first gap 24 at the opening end to allow the insertion of a strap or the like within the first gap 24. The first top portion 20 comprises relief channels 28 that allow for repeated flexion of the first top portion 20 without breaking. This flexion occurs when using, or removing a headlamp, or goggle straps, or a future accessory that utilizes a strap. The small clip 12 can be open at one end to allow the user to insert several different types of straps, or alternatively, the small clips can be designed to fully enclose a strap, and slide along the strap to a desired position of attachment, thereby providing for virtually zero chance of strap loss.

Referring further to the drawings, FIGS. 3A-3E depict a large clip 14 according to particular embodiments of the present invention. The large clip 14 comprises a second top portion 30, a second bottom portion 32 and a second gap 34 between the top portion 30 and the second bottom portion 32. The second gap 34 is formed by the coupling of the second top portion 30 to the second bottom portion 32 on one end, wherein the second gap 34 may resemble a channel when viewed from a side of the large clip 14. The second gap 34 has a second width W2. On an interior side of the second top portion 30, wherein the interior side comprises the side facing the second bottom portion 32, a second protrusion 31 is coupled to an end adjacent an opening of the second gap 34. The second protrusion 31 may function to engage a strap by friction or by extending on side of a strap inserted within the second gap 34. The small clip may comprise a third length D3 taken in a direction from the open end to the closed end of the second gap 34 and a fourth length D4 taken in a direction extending from one side to the other side of the second gap 34.

The second bottom portion 32 may include a concave surface 36. The concave surface 36 operates to accommodate the round and/or conical shape found in common headgear and helmets. Coupled to the concave surface 36 is an second adhesive layer 39. The adhesive layer may further include a paper backing (not shown) wherein a user may remove the paper backing and apply the second adhesive layer 39 to protective headgear at a user determined location. The second adhesive layer 39 retains the large clip 14 in that location and further secures the second bottom portion 32 in a fixed relationship with respect to the headgear. Once the second bottom portion 32 is secured in this fixed relationship with respect to the headgear, the top portion may flex in order to widen the second gap 34 at the opening end to allow the insertion of a strap or the like within the second gap 34. The second top portion 30 comprises relief channels 38 that allow for repeated flexion of the second top portion 30 without breaking. This flexion occurs when using, or removing a headlamp, or goggle straps, or a future accessory that utilizes a strap. The large clip 14 can be open at one end to allow the user to insert several different types of straps, or alternatively, the small clips can be designed to fully enclose a strap, and slide along the strap to a desired position of attachment, thereby providing for virtually zero chance of strap loss.

The small clip 12 and the large clip 14 may vary in size and function. For example, and without limitation, the various dimensions discussed with respect to each clip may vary. In some embodiments, D3 may be greater than D1; D4 may be greater than D2; and W2 may be greater than W1. In other embodiments, D3 may be equal to D1; D4 may be greater than D2; and W2 may be greater than W1. In yet other embodiments, D3 may equal D1; D4 may equal D2; and W2 may be greater than W1. As can be seen from these examples, the large clip 14 always maintains a second gap 34 having a width W2 that is greater than width W1 of the first gap 24 of the small clip 12. The larger second gap 34 having width W2 allows for larger straps or multiple straps to be secured within the same clip.

Figure 4A:
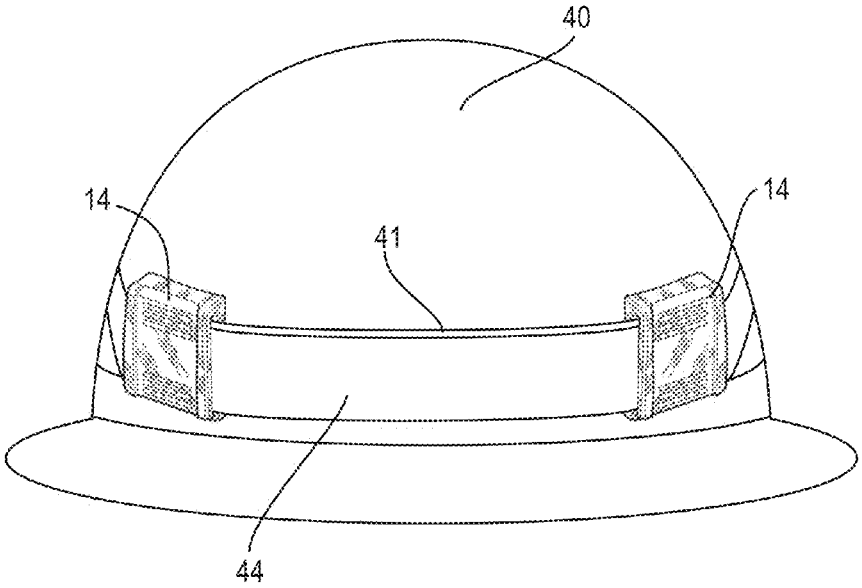
FIGS. 4A-4C are perspective views of a headgear appliance mounting and retention system.
Figure 4B:
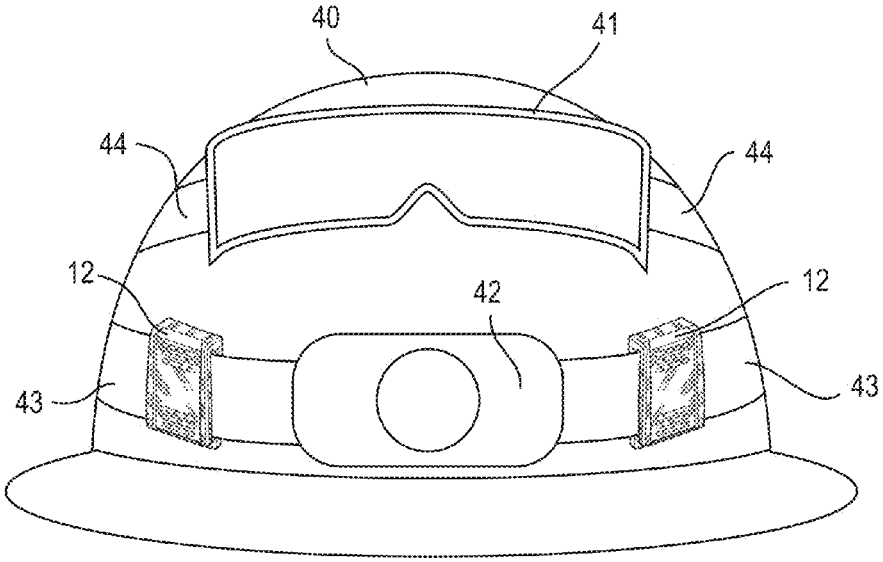
Figure 4C:
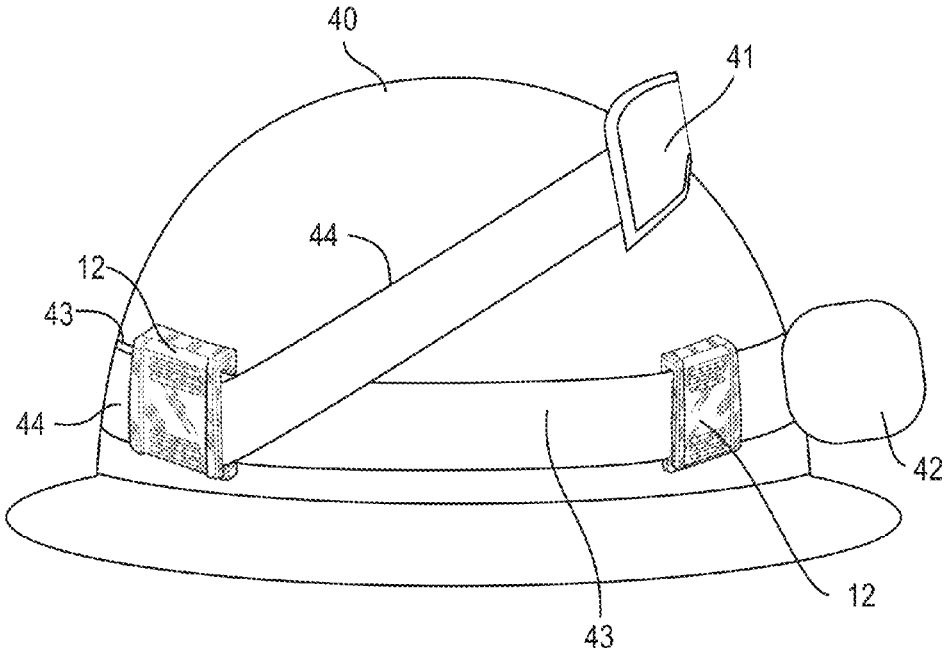

This is particularly useful as shown in FIGS. 4A-4C, wherein the system 10 includes two small clips 12 and two large clips 14 secured in user defined locations on headgear 40. A lamp accessory 42 comprises a strap 43 that is removably retained within the clip system 10 by inserting the strap within the small clips 12 and the large clips 14. The goggles 41 comprise a strap 44 and are removably retained within the large clips 14 only, thereby placing two straps within the large clips 14. This allows the user to move the goggles 41 on and off the user's eyes, while retaining them on a back end of the strap to the headgear 40. Because the large clips 14 have a second gap 34 with a width W2 greater than the width W2 of the first gap 24 of the small clips 12, the large clips 14 can receive and retain two straps within the second gap 34. Accordingly, the larger version of the specially designed clip components (large clip 14) in the system 10 are specifically designed to retain multiple straps, or larger straps, even when the straps may additionally be attached to a large battery pack. The smaller version of the specially designed clip components (small slips 12) in the system 10 are designed to hold smaller straps commonly found in the front of the headlamp, keeping the light module pointing in the direction the end user intended when installing the system. This system 10 can be retrofitted to any style helmet, or headgear, and accommodates virtually any headlamp, and goggle, or accessory strap.

The specially designed clip components (small clips 12 and large clips 14) of the system 10 may be made from a proprietary thermoplastic (P.A. 6.6 with a glass fill) that with a fiberglass fill to withstand the high temps that are often encountered in activities such as firefighting. The system 10 also incorporates the adhesive layers 29 and 39, which may be an adhesive backing similar to 3M VHB adhesive tape (trademark of 3M), or other suitable adhesive. The system 10 is not limited in design to only being manufactured from a polymer, the design allows for manufacture of any suitable or equivalent material. The adhesive layers 29 and 39 typically disposed on the specially designed clips 12 and 14 are designed to be targeted to the particular substrate of the helmet, or headgear that the system is intended to be used on and can vary from headgear to headgear. The backing surface area is designed to hold fast against the forces encountered when holding straps in place on a conical helmet while they are used in a violent manner as a may be found in firefighting, utility work, or industrial safety, or recreational use.

Other description and images are provided in the Appendix, the disclosure of which is incorporated entirely herein by reference.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A headgear appliance mounting and retention system, the system comprising:

a first accessory having a first strap;

a second accessory having a second strap; and a set of clips, the set of clips comprising two small clips and at least one large clip, the two small clips having a size less than the at least one large clip wherein:

each small clip retains the first strap of the first accessory and comprises:

a first top portion having relief channels;

a first bottom portion having a concave bottom surface;

a first gap between the first top and first bottom portions, the first gap having a first width; and a first adhesive layer coupled to the concave bottom surface of the first bottom portion, wherein the two small clips are coupled toward the front portion of the headgear on opposing sides of a headgear; and the at least one large clip retains the first strap of the first accessory and the second strap of the second accessory and comprises:

a second top portion having relief channels;

a second bottom portion having a concave bottom surface;

a second gap between the second top and second bottom portions, the second gap having a second width, wherein the first width of the first gap of each of the small clips is less than the second width of the second gap of the large clip; and a second adhesive layer coupled to the concave bottom surface of the second bottom portion, wherein the at least one large clip is coupled toward a back portion of the headgear.

2. The system of claim 1, wherein the adhesive layer of each small clip couples the small clip to a user defined location on a headgear and the second adhesive layer of each large clip couples the large clip to another user defined location on the headgear.

3. The system of claim 1, wherein the first top portion and the first bottom portion of each small clip are coupled together on one end having an open end and sides.

4. The system of claim 3, wherein the first top portion of each small clip flexes in order to widen the first gap at the open end to allow the insertion of a strap of an accessory within the first gap.

5. The system of claim 4, wherein the relief channels of the first top portion of each small clip are located at a distal end of the first top portion and allow for repeated flexion of the first top portion without breaking.

6. The system of claim 3, wherein the small clip further comprises a first protrusion coupled to the first top portion adjacent the open end, wherein the first protrusion engages a strap of an accessory by one of friction or extending on one side of the strap inserted within the first gap.

7. The system of claim 1, wherein the second top portion and the second bottom portion of the large clip are coupled together on one end having an open end and sides.

8. The system of claim 7, wherein the second top portion of the large clip flexes in order to widen the second gap at the open end to allow the insertion of one or more strap of one or more accessories within the second gap.

9. The system of claim 8, wherein the relief channels of the second top portion of the large clip are located at a distal end of the second top portion and allow for repeated flexion of the second top portion without breaking.

10. The system of claim 7, wherein the large clip further comprises a second protrusion coupled to the second top portion adjacent the open end, wherein the second protrusion engages one or more strap of one or more accessories inserted within the second gap.

11. A headgear appliance mounting and retention system, the system comprising:

a first accessory having a first strap;

a second accessory having a second strap; and a set of clips, the set of clips comprising at least three clips, wherein the at least three clips comprises at least one large clip, wherein:

two of the at least three clips are coupled toward the front portion of the headgear on opposing sides of the headgear and retain at least the first strap of the first accessory and comprises:

a top portion;

a bottom portion having a concave bottom surface;

a gap between the top and bottom portions, the gap having a width; and an adhesive layer coupled to the concave bottom surface of the bottom portion; and the at least one large clip of the set of clips is coupled toward a back portion of the headgear and retains the first strap of the first accessory and the second strap of the second accessory and comprises:

a top portion having relief channels;

a bottom portion having a concave bottom surface;

a gap between the top and bottom portions, the gap having a width, wherein the width of the gap is sized to receive the first strap of the first accessory and the second strap of the second accessory; and an adhesive layer coupled to the concave bottom surface of the bottom portion.

* * * * *